US005367826A

United States Patent [19]

Wu

[11] Patent Number: 5,367,826

[45] Date of Patent: Nov. 29, 1994

[54] MECHANICAL HATCH LIFTING MECHANISM

[76] Inventor: John N. Wu, 139 Putnam Dr., Erie, Pa. 16511

[21] Appl. No.: 963,619

[22] Filed: Oct. 20, 1992

[51] Int. Cl.[5] ..... E05F 11/24

[52] U.S. Cl. ..... 49/343

[58] Field of Search ..... 49/339, 340, 343, 362; 105/26.05, 453, 35

[56] References Cited

U.S. PATENT DOCUMENTS

| | | | |
|---|---|---|---|
| 677,894 | 7/1901 | Norton | 49/343 |
| 2,366,613 | 1/1945 | Hagstrom | 49/399 X |
| 2,385,642 | 9/1945 | Peterson, Jr. | 105/456 X |
| 2,594,643 | 4/1952 | Gustisha | 49/343 X |
| 2,802,428 | 8/1957 | Redyard, Jr. | 105/35 |
| 4,186,665 | 2/1980 | de Jong et al. | 105/26.05 X |
| 4,821,456 | 4/1989 | Nogaki | 49/362 |

FOREIGN PATENT DOCUMENTS

| | | | |
|---|---|---|---|
| 14199 | of 1916 | United Kingdom | 49/343 |

*Primary Examiner*—Philip C. Kannan

[57] ABSTRACT

In a system for providing access to a diesel engine of a locomotive, a hatch lifting mechanism is pinned to a hatch for enhancing the capabilities of pushing and pulling the hatch during its opening and closing operation. The hatch lifting mechanism allows the hatch to be set open at any desired position, using a positive rigid support at the desired position. The system further includes a two-force member comprising a collar, an ACME threaded rod, and a plunger situated inside a pipe, with minimal bending exerted on the hatch. Placing all of the moving elements inside the pipe enables the mechanism to operate in a hostile environment and in a confined space. The design of the hatch lifting mechanism of the present invention also prevents a lock-tight phenomenon between the collar and the plunger when the rod is fully extended out of the pipe.

9 Claims, 3 Drawing Sheets

MECHANICAL HATCH LIFTING MECHANISM

BACKGROUND OF THE INVENTION

The present invention relates to automotive and locomotive vehicle hatches and, more specifically, to a lifting mechanism for lifting a heavy hatch or cover on a vehicle, such as a locomotive engine compartment.

It is well known in the art to provide hatch lifting mechanisms which use either compressed gas or liquid dashpot to slowly lift hatches on automotive vehicles. Hatch lifting mechanisms are necessary to lift heavy weight covers by mechanical leverage. For example, such hatch lifting mechanisms are provided in side panels of locomotives for access to the diesel engine.

Unfortunately, such hatch lifting mechanisms tend to deteriorate over time, as a function of time and operating temperature. This can result in falling hatches, which is particularly hazardous when a worker is ducked under the lifted hatch while conducting repairs, installations, or other work.

One way to help overcome these problems is to station two people at the hatch, one to conduct the work and one to monitor the hatch. Obviously, this method has problems, in that it does not eliminate falling hatches. Nor is this method a failsafe method for preventing injury. Finally, this method has the added expense of requiring two persons to do the job of one person, in the same amount of time.

It is seen then that there exists a need for a hatch lifting mechanism which will support the hatch in an open position without the need of additional workers, and without fear of the hatch falling.

SUMMARY OF THE INVENTION

This need is met by the mechanical hatch lifting mechanism according to the present invention, which is capable of lifting and holding in position a heavy hatch or cover on any vehicle, specifically on a locomotive engine compartment. The invention utilizes a hatch lift assembly pinned or otherwise attached to the hatch, enhancing the capabilities of pushing and pulling the hatch during its opening or closing operation. The opening of the hatch can be set at any position by the operator, with a positive rigid support at that position, without the fear of the hatch falling down when the operator is working under it.

In accordance with one embodiment of the present invention, a system provides access to a diesel engine of a locomotive. The system comprises a hatch lifting mechanism pinned or otherwise attached to a hatch for enhancing the capabilities of pushing and pulling the hatch during its opening and closing operation. The hatch lifting mechanism allows the hatch to be set open at any desired position, using a positive rigid support at the desired position. The system further includes a two-force member comprising a collar, an ACME threaded rod, and a plunger situated inside a pipe, with minimal bending exerted on the hatch. Placing all of the moving elements inside the pipe enables the mechanism to operate in a hostile environment and in a confined space. The design of the hatch lifting mechanism of the present invention also prevents a lock-tight phenomenon between the collar and the plunger when the rod is fully extended out of the pipe.

Accordingly, it is an object of the present invention to provide a hatch lifting mechanism which is capable of lifting and holding in position a heavy hatch or cover on any vehicle, specifically on a locomotive engine compartment. It is a further object to provide such a hatch lifting mechanism under which an operator can safely work.

These and other objects will become apparent from a reading of the ensuing description together with the appended drawings and claims.

DETAILED DESCRIPTION OF THE PREFERRED EMBODIMENTS

Figure 1:
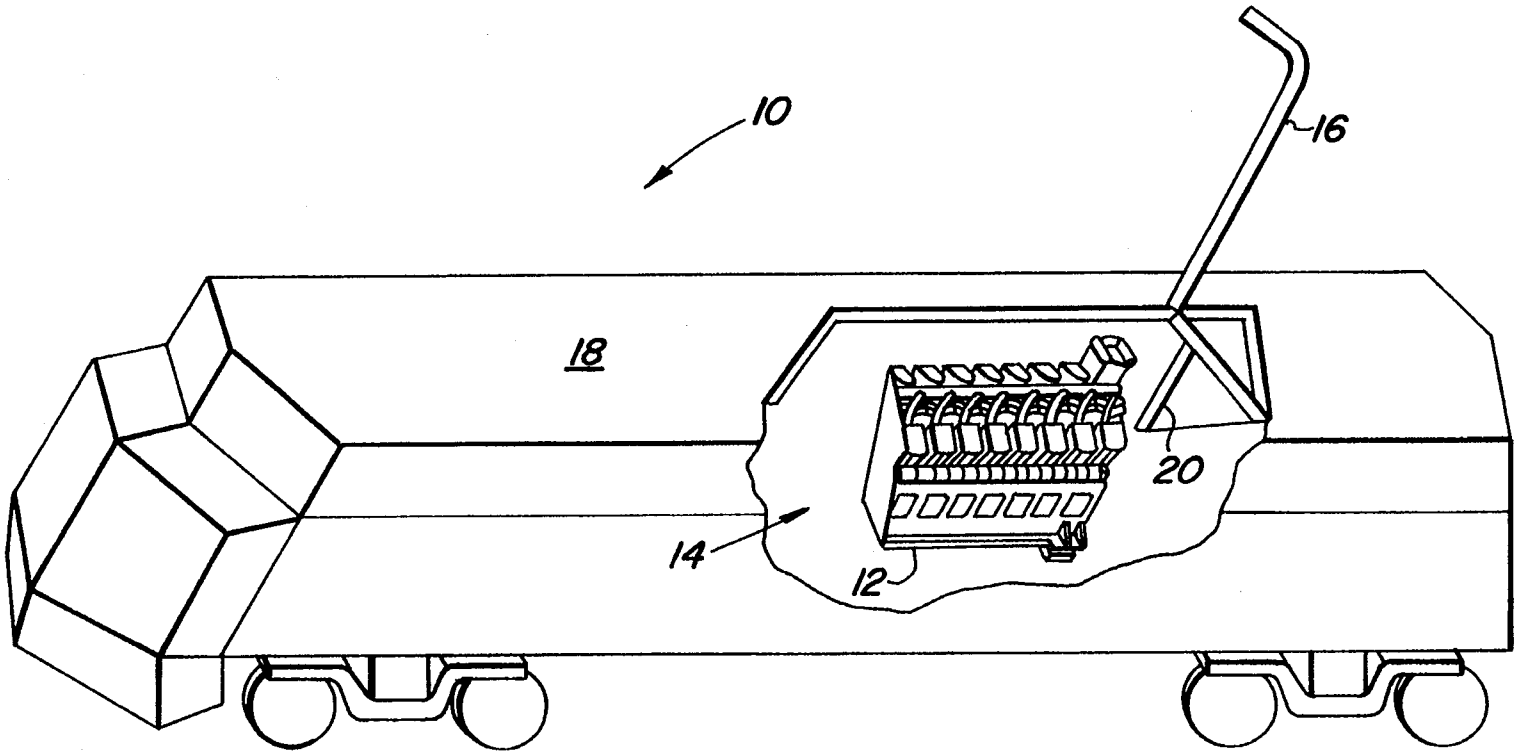
FIG. 1 is an illustration of a hatch lifting mechanism of the present invention, being used to open a hatch door of a conventional locomotive to permit access to the cutaway locomotive diesel engine compartment.

Referring now to the drawings, in FIG. 1 there is illustrated a typical diesel electric locomotive 10, wherein access to a diesel engine 12 in a diesel engine compartment 14 is allowed through a hatch door 16 located on the roof 18 of the locomotive 10. The hatch door 16 is held open with a mechanical hatch lifting mechanism 20, of the present invention. The hatch lifting mechanism 20 is capable of lifting the door 16, and is shown in an open position.

Although the hatch lifting mechanism 20 may be used to permit access to any opening, particularly any vehicle opening, it is described herein as being used to allow access to the diesel engine 12 of a locomotive 10. This description is for purposes of illustration only and is not to be considered as limiting the scope of the invention.

Figure 2:
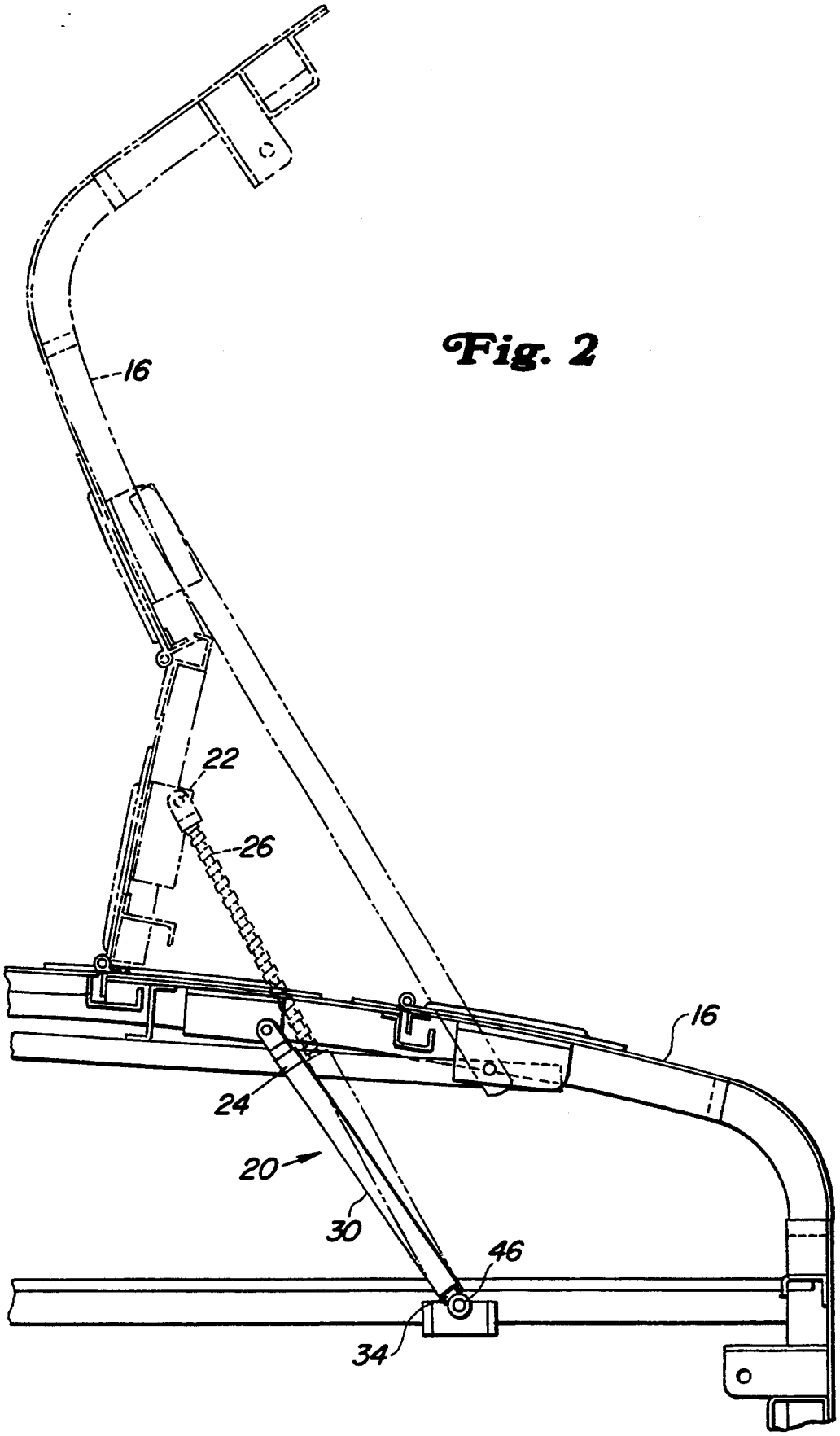
FIG. 2 is an enlarged view of the hatch lifting mechanism of FIG. 1, showing the hatch door and hatch lifting mechanism in an open position superimposed on the hatch door and hatch lifting mechanism in a closed position.

Referring now to FIG. 2 and continuing with FIG. 1, an enlarged view of the hatch lifting mechanism 20, holding the hatch door 16 open, is shown. The hatch lifting mechanism 20 enables the lifting of a heavy hatch door 16 or other cover such as on any vehicle, and specifically on the locomotive engine compartment 14. Although the hatch lifting mechanism 20 applies the same principle as a mechanical jack, which is used to lift a heavy weight by mechanical leverage, the hatch lifting mechanism 20 of the present invention differs from an ordinary mechanical jack in that the mechanism 20 is pinned to the hatch door 16, with a pin attachment means 22. This enhances the capabilities of pushing and pulling the hatch door 16 during its opening and closing operation. The opening of the hatch door 16 differs from a dashpot device in that the door 16 can be set at any position by the operator with the positive rigid support mechanism 20 at that position, without fear of the hatch door 16 falling down on the operator as the operator is working under the door 16, in the engine compartment 14.

Figure 3A:
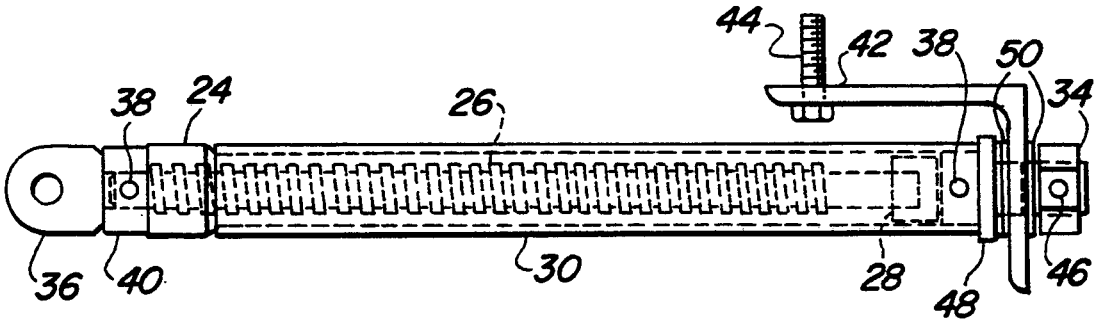
FIG. 3A is a cross-sectional view of the hatch lifting mechanism of FIG. 2 in a closed position.
Figure 3B:
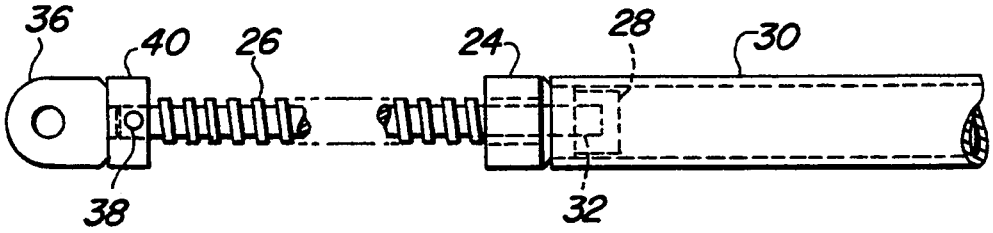
FIG. 3B is a partial cross-sectional view of the hatch lifting mechanism of FIG. 2 in a full open position.

Referring now to FIGS. 3A and 3B, and continuing with FIG. 2, the combination of a collar 24, a rod 26, and a plunger 28 inside a pipe 30 provides a unique operation of a two-force member with minimal bending exerted on the device. An unthreaded portion 32 of the rod 26, at a bottom end of the rod 26, is situated between the rod 26 and the plunger 28 to provide a unique lock-tight prevention feature. The unthreaded portion 32 prevents the lock-tight phenomenon between the collar 24 and the plunger 28 when the rod 26 is fully extended out of the pipe 30, as shown in FIG. 3B. The purpose of this arrangement is to prevent any locking situation from happening when the rod 26 has been fully extended, and the door 16 fully opened, but the operator inadvertently continues to turn or manipulate a hatch moving means 34.

Continuing with FIGS. 3A and 3B, the rod 26 and plunger 28 are screwed through the collar 24, which only rotates but does not extend or move. When the rod 26 reaches the fully extended or open position, its threaded portion disengages from the threaded collar 24, causing the rod 26 to discontinue upward movement. When the rod 26 is fully extended, the plunger 28 hits the collar 24, causing the unthreaded portion 32 of the rod 26 to be in the collar 24. The collar 24 functions as a jack during the opening of the hatch door 16, until the door 16 is fully opened. At this point, the jack action is no longer needed, and the unthreaded portion 32 is in the collar 24, so there is no thread engagement to cause a jack action. So even if the operator inadvertently continues to turn or manipulate the hatch moving means 34, there will not be any thread engagement between the rod and plunger portion of the mechanism 20 and the collar 24, thereby preventing the lock-tight phenomenon between the collar 24 and the plunger 28 when the rod 26 is fully extended out of the pipe 30.

When the hatch moving means 34 is turned in the direction to open the hatch door 16, the entire cylindrical pipe 30 turns and the collar 24, preferably welded to the pipe 30, rotates. So as the collar 24 rotates, it is operating as a jack to screw the rod 26 outward. As the rod 26 and the plunger 28, attached to the rod 26, are screwed outward by the rotating collar 24, a support means comprised of a lifting lug 36, a roll pin 38, and an attachment 40, is also forced outward, to prop open the hatch door 16. To close the hatch door 16, the rod 26 is pushed down by the weight of the hatch door 16 and its threads reengage with the collar 24. Consequently, when the hatch moving means 34 is turned to close the hatch door 16, the unthreaded portion 32 of the rod 26 will exit the collar 24, and the rod 26 will then be screwed down by the collar 24. The unthreaded portion 32 is preferably slightly longer than the thickness of the collar 24, such as approximately one-half inch in length, to maximize the efficiency of the lock-tight prevention feature and allow rotation without propagation.

The design of containing all of the moving components inside the pipe 30 when the door 16 is closed, enables the mechanism 20 to operate in a hostile environment and in a limited space when manipulating the hatch door 16. The design of the hatch lifting mechanism 20 of the present invention has the further advantages of requiring minimal maintenance and providing high reliability.

Continuing with FIGS. 3A and 3B, the hatch lifting mechanism 20 includes the top end plate or lifting lug 36 attached to the hatch door 16, and an L-shaped bracket angle 42 attached to a frame, via a mounting means such as bolt 44, on the bulkhead of the locomotive roof 18. Hence, as explained above, while an operator turns the hatch moving means, preferably the hex nut 34, either manually or with a pneumatic device in a counter clockwise direction at the bottom of the lifting mechanism 20, the top part of the rod 26 moves up, thereby lifting the hatch door 16. Conversely, as the operator causes the hex nut 34 to be turned in a clockwise direction, the hatch door 16 closes.

The hex nut 34 is screwed and locked by a spring pin 46 to an end plug 48, which in turn locks with the pipe 30 by the roll pin 38. The threaded collar 24, with internal ACME threads is welded on the other end of the pipe 30, as illustrated in FIG. 3A. Therefore, the hex nut 34, end plug 48, pipe 30, and threaded collar 24 rotate together as a single rigid piece. The L-shaped bracket 42 acts as a bearing and provides thrust bearing surfaces between washes 50. As explained above, rotation of the hex nut 34 causes rotation of the pipe 30 and the threaded collar 24, which screws the rod 26, having external ACME threads, up or down, depending on the direction of rotation of the hex nut 34. The rod 26 is prevented from rotation at the top by the lifting lug 36, pinned to the hatch door 16. The internal plunger 28 is welded in the lower end of the rod 26 and slides inside the pipe 30 in a longitudinal direction as the rod 26 moves up and down. The purpose of the plunger 28, then, is to stabilize the rod 26 movement axially and increase the strength of the resistance to bending of the mechanism 20.

Having described the invention in detail and by reference to the preferred embodiment thereof, it will be apparent that other modifications and variations are possible without departing from the scope of the invention defined in the appended claims.

What is claimed is:

1. A hatch lifting mechanism for enhancing the capabilities of pushing and pulling a hatch during hatch opening and closing operations, the hatch lifting mechanism being operatively connected to the hatch and comprising;

hollow guide means;

a rod having a threaded and at least one unthreaded portion;

a lock tight prevention means, operatively connected to the rod and operatively positioned in the hollow guide means, for causing the rod to discontinue upward movement; and rotational means, operatively associated with the hollow guide means, for selectively opening and closing the hatch.

2. The hatch lifting mechanism of claim 1 wherein turning the rotational means in one direction lifts the hatch and turning the rotational means in an opposite direction closes the hatch.

3. The hatch lifting mechanism of claim 1 further comprising:

means for screwing and locking the rotational means to an end plug.

4. The hatch lifting mechanism of claim 1 further comprising:

means for providing operation of a two-force member with minimal bending being exerted on the hatch.

5. A system for providing access to a diesel engine compartment of a locomotive, the system comprising:

an engine compartment hatch;

a hatch lifting mechanism, operatively connected to the hatch, for enhancing the capabilities of pushing and pulling the hatch during hatch opening and closing operations, the hatch lifting mechanism comprising:

hollow guide means;

a rod having a threaded and at least one unthreaded portion;

a lock tight prevention means, operatively connected to the rod and operatively positioned in the hollow guide means, for causing the rod to discontinue upward movement; and rotational means, operatively associated with the hollow guide means, for selectively opening and closing the engine compartment hatch.

6. The system of claim 5 wherein the hatch lifting mechanism further comprises:

means for setting the opening of the hatch at a plurality of desired positions.

7. The system of claim 6 wherein the opening setting means comprises:

a positive rigid support at the desired position.

8. A locomotive comprising:

at least two trucks for supporting the locomotive on a rail system;

a locomotive body operatively positioned on the trucks;

an engine, operatively positioned in an engine compartment associated with the body;

a hatch, operatively connected to the body, for enclosing at least a portion of the engine compartment;

a lifting mechanism, operatively connected to the hatch and the locomotive body, for lifting the hatch and providing access to the engine compartment, wherein the lifting mechanism further comprises:

means for pivotably connecting the hatch to the locomotive body;

a threaded rod having at least one unthreaded end portion;

a hollow member, operatively Connected to the hatch and to the locomotive body, for housing the rod;

a collar., operatively connected to the hollow member and adapted to cooperate with the rod;

a plunger, operatively connected to the unthreaded end of the rod, for preventing the collar and the rod from locking when the rod is fully extended from the hollow member.

9. A locomotive comprising:

at least two trucks for supporting the locomotive on a rail system;

a locomotive body operatively positioned on the trucks;

an engine, operatively positioned in an engine compartment associated with the body;

a hatch, operatively connected to the body, for enclosing at least a portion of the engine compartment; and a lifting mechanism, operatively connected to the hatch and the locomotive body, for enhancing the capabilities of pushing and pulling the hatch during hatch opening and closing operations, the lifting mechanism comprising;

hollow guide means;

a rod having a threaded and at least one unthreaded portion;

a lock tight prevention means, operatively connected to the rod and operatively positioned in the hollow guide means, for causing the rod to discontinue upward movement; and rotational means, operatively associated with the hollow guide means, for selectively opening and closing the hatch.

* * * * *

UNITED STATES PATENT AND TRADEMARK OFFICE

CERTIFICATE OF CORRECTION

PATENT NO. : 5,367,826
DATED : November 29, 1994
INVENTOR(S) : John N. Wu

It is certified that error appears in the above-indentified patent and that said Letters Patent is hereby corrected as shown below:

On the title page, insert the following information:

[73] Assignee: General Electric Company,
Erie, Pennsylvania

Signed and Sealed this

Second Day of May, 1995

*Attest:*

Bruce Lehman

BRUCE LEHMAN

*Attesting Officer*

*Commissioner of Patents and Trademarks*